US008330027B2

(12) United States Patent
Kono

(10) Patent No.: US 8,330,027 B2
(45) Date of Patent: Dec. 11, 2012

(54) LID STRUCTURE OF KEYBOARD INSTRUMENT

(75) Inventor: Hiroki Kono, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 13/343,715

(22) Filed: Jan. 5, 2012

(65) Prior Publication Data

US 2012/0174726 A1 Jul. 12, 2012

(30) Foreign Application Priority Data

Jan. 12, 2011 (JP) ..... 2011-003601

(51) Int. Cl.
*G10C 3/02* (2006.01)

(52) U.S. Cl. ..... 84/179

(58) Field of Classification Search ..... 84/423 R, 84/438, 173, 174, 177–179
See application file for complete search history.

(56) References Cited

U.S. PATENT DOCUMENTS 6,673,991 B2 * 1/2004 Hara ..... 84/179
7,700,860 B2 4/2010 Nagayama

* cited by examiner

*Primary Examiner* — Kimberly Lockett
(74) *Attorney, Agent, or Firm* — Jianq Chyun IP Office

(57) ABSTRACT

A lid structure of a keyboard instrument is provided, which improves a design degree of freedom of an instrument body. When a covered keyboard is changed from a close state to an open state, a front lid rotates relative to a back lid through a rotation shaft. A front guide slot and a rack built in the instrument body are used to guide backward movements of an engagement pin and a pinion. Since the rack is located posterior to the front guide slot, the back lid approximately maintains a pose to move backwards. A height of an accommodating space of the instrument body set to the open state is only required to be equal to a thickness of the back lid. Therefore, the accommodating space is reduced, an overall height of the instrument body is suppressed and a design degree of freedom of the instrument body is improved.

5 Claims, 6 Drawing Sheets

LID STRUCTURE OF KEYBOARD INSTRUMENT

CROSS-REFERENCE TO RELATED APPLICATION

This application claims the priority benefit of Japan application serial no. 2011-003601, filed on Jan. 12, 2011. The entirety of the above-mentioned patent application is hereby incorporated by reference herein and made a part of this specification.

BACKGROUND OF THE INVENTION

1. Field of the Invention

The invention relates to a lid structure of a keyboard instrument. Particularly, the invention relates to a lid structure of a keyboard instrument capable of enhancing a design degree of freedom of an instrument body.

2. Description of Related Art

Traditionally, a lid structure of a keyboard instrument such as an electronic piano or an electronic organ has a front lid capable of rotating and a back lid capable of sliding back and forth. For example, Patent document 1 discloses a lid structure having a back lid (a front panel) erected on an instrument body in a close state and a front lid (a keyboard lid) connected to the back lid through a rotation shaft. The instrument body has guide slots formed along a back and forth direction, and pins configured in protrusion at two sides of the back lid are engaged to the guide slots. The instrument body further has a slide arm capable of being sliding supported along the back and forth direction. And, the slide arm is disposed under the guide slot along the guide slot. In this way, in the close state, the keyboard and an operation panel disposed posterior to the keyboard are covered by the front lid and the back lid.

In an open state, the front lid is rotated along the rotation shaft as a centre and is folded to the back lid. In this way, the keyboard can be opened to a player side, and the instrument is arranged to be a playable state. Started from the playable state, the folded front lid and the back lid are flipped over to the slide arm, while the flipping state is maintained, the back lid, the slide arm and the front lid are moved backwards along the guide slot. In this way, the slide arm, the front lid and the back lid are accommodated in the instrument body, so that the keyboard and the operation panel can be opened to the player side, and the player can both operate the operation panel and operate the keyboard.

DOCUMENTS OF PRIOR ART

Patent Document

[Patent document] Japan Patent Publication No. 2007-188019

However, in the technique disclosed by the Patent document 1, the guide slot and the slide arm are located on the top and under of the instrument body, so that the slide arm, the front lid and the back lid are accommodated in an accommodating space of the instrument body in a stacking state. Therefore, a height of the accommodating space has to be greater than a sum of a height of the slide arm, a thickness of the front lid and a thickness of the back lid. As a result, when the instrument body is designed, the height of the accommodating space has to be considered, which greatly limits the design of the instrument body.

SUMMARY OF THE INVENTION

The invention is directed to a lid structure of a keyboard instrument capable of enhancing a design degree of freedom of an instrument body.

A first technical solution of the invention provides a lid structure of a keyboard instrument, which covers a keyboard and an operation panel disposed posterior to the keyboard in a free open-and-close manner. When the covered keyboard is changed from a close state to an open state, a front lid rotates relative to a back lid through a rotation shaft. Moreover, a front guide portion built in an instrument body is used to guide a backward movement of a front engagement portion of the back lid, and a back guide portion built in the instrument body is used to guide the backward movement of a back engagement portion of the back lid. Since the back guide portion is located posterior to the front guide portion, the back lid can approximately maintain a pose to move backwards. Therefore, a height of an accommodating space of the instrument body set to the open state for accommodating the lid is only required to be equal to a thickness of the back lid. In this way, the height of the accommodating space of the instrument body used for accommodating the lid is reduced, and following effects are achieved, i.e. an overall height of the instrument body can be suppressed and a design degree of freedom of the instrument body can be enhanced.

According to a second technical solution of the lid structure of the keyboard instrument, at least one of the front engagement portion, the front guide portion, the back engagement portion and the back guide portion has a stop portion, which stops a movement of the back lid along a back and forth direction, so as to open the keyboard relative to a player side. On the other hand, the operation panel is covered relative to the player side. In this way, the keyboard instrument closely appears to an acoustic piano.

Along the back and forth direction, the front lid is shorter than the keyboard in length, so that even if the height of the instrument body is not greater than the required height, a front end of the front lid located at a rotation stop position in the open state does not protrude out from the top of the instrument body. Therefore, asides from the effects of the first technical solution, the following effects are further achieved, i.e. regarding the length of the front lid, the total height of the instrument body is suppressed and a design degree of freedom of the instrument body is enhanced.

According to a third technical solution of the lid structure of the keyboard instrument, the front engagement portion is formed on an arm extending downwards from the back lid, and the front engagement portion and the front guide portion are located under the operation panel, so that the front engagement portion and the front guide portion are inconspicuously located. Therefore, asides from the effects of the first technical solution or the second technical solution, the following effects are further achieved, i.e. the front engagement portion and the front guide portion are prevented from becoming obstruction, and the keyboard instrument has a good appearance.

According to a fourth technical solution of the lid structure of the keyboard instrument, the front engagement portion or the front guide portion extends along the back and forth direction of the instrument body, and a back portion is located above the front portion in the instrument body, so that as the back lid moves forwards, the front portion of the back lid descends, and as the back lid moves backwards, the front portion of the back lid ascends. Therefore, even if the operation panel is disposed at a place higher than that of the keyboard, or is disposed oblique to the player, interference between the front portion of the back lid and the operation panel is prevented as the back lid moves along the back and forth direction. Therefore, asides from the effects of any one of the first technical solution to the third technical solution, the following effects are further achieved, i.e. a design degree of freedom of the operation panel and of configuration position is enhanced.

According to a fifth technical solution of the lid structure of the keyboard instrument, the rotation shaft has a torque shaft unit, and the torque shaft unit produces a specified torque when the front lid is rotated relative to the back lid along a close direction. In this way, asides from the effects of any one of the first technical solution to the fourth technical solution, the following effects are further achieved, i.e. it is unnecessary to additionally set a torque shaft unit around the rotation shaft, so that a space around the rotation shaft is effectively used to beautify the device appearance, and an effect that the front lid is slowly closed during a close operation is achieved.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 1(*b*) is a top view of a keyboard instrument with partially-sliced front lid 8*a* and back lid 8*b*.

DETAILED DESCRIPTION OF DISCLOSED EMBODIMENTS

Figures 1A, 1B:
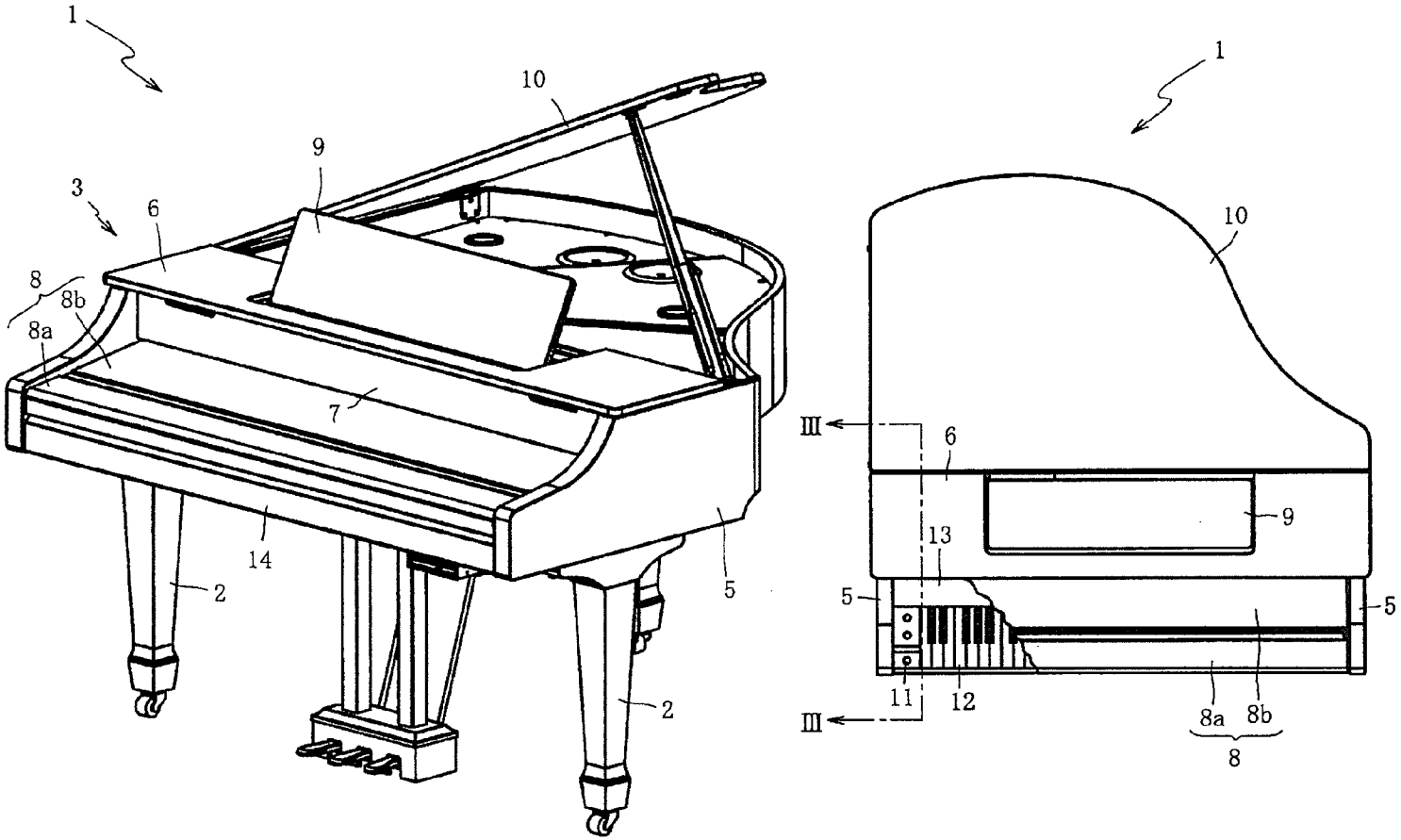
FIG. 1(*a*) is a three-dimensional of a keyboard instrument adapted to a lid structure of an embodiment of the invention.

Exemplary embodiments of the invention are provided below with reference to the figures. Firstly, a keyboard instrument 1 adapted to a lid structure of an embodiment of the invention is described with reference to FIG. 1(*a*) and FIG. 1(*b*). FIG. 1(*a*) is a three-dimensional view of a keyboard instrument 1 adapted to a lid structure of an embodiment of the invention. FIG. 1(*b*) is a top view of the keyboard instrument 1 with partially-sliced front lid 8*a* and back lid 8*b*. Moreover, FIG. 1(*a*) illustrates an erected music score board 9 and an opened large top lid 10. FIG. 1(*b*) illustrates the laid-down music score board 9 and the closed large top lid 10. In addition, the left and right of the keyboard instrument 1 are determined according to an observation direction of a player. Regarding the front and back of the keyboard instrument 1, a player side of the keyboard instrument 1 is regarded as the "front". Relations of the left and right and the front and back of the keyboard instrument 1 are the same in the claims.

As shown in FIG. 1(*a*), the keyboard instrument 1 has a plurality of legs 2 and an instrument body 3 supported by the legs 2. The instrument body 3 mainly includes a shelf 4 (referring to FIG. 3) supported by the legs 2; side plates 5 erected at two sides of the shelf 4; a top plate 6 mounted to the side plates 5; a front plate 7 vertically disposed on the top plate 6 and a keyboard lid 8 disposed under the front plate 7. The music score board 9 may be erected on the top plate 6, and the large top lid 10 is disposed posterior to the top plate 6 and is coplanar to the top plate 6 in a close state. The keyboard lid 8, in the close state, is disposed in an approximately horizontal configuration between the right and left side plates 5, and has a rectangular front lid 8*a* disposed aside the player and a rectangular back lid 8*b* connected to the back of the front lid 8*a*.

As shown in FIG. 1(*b*), the keyboard lid 8, in the close state, is used to cover a wooden clapper 11, a keyboard 12 and an operation panel 13. The operation panel 13 is used to set a functional device (not shown) of the electronic instrument such as an operation device used for setting or sound control of the keyboard instrument 1 or a display device used for displaying various information. The operation panel 13 is disposed between the left and the right side plates 5 and located behind the wooden clapper 11 and the keyboard 12. In the present embodiment, a part of the operation devices such as a power switch of the keyboard instrument 1 or a pilot lamp is disposed on the wooden clapper 11. Moreover, the front lid 8*a* along the back and forth direction is shorter than the keyboard 12 in length, and in the close state, the front lid 8*a* and the back lid 8*b* cover the wooden clapper 11, the keyboard 12 and the operation panel 13.

Figure 2:
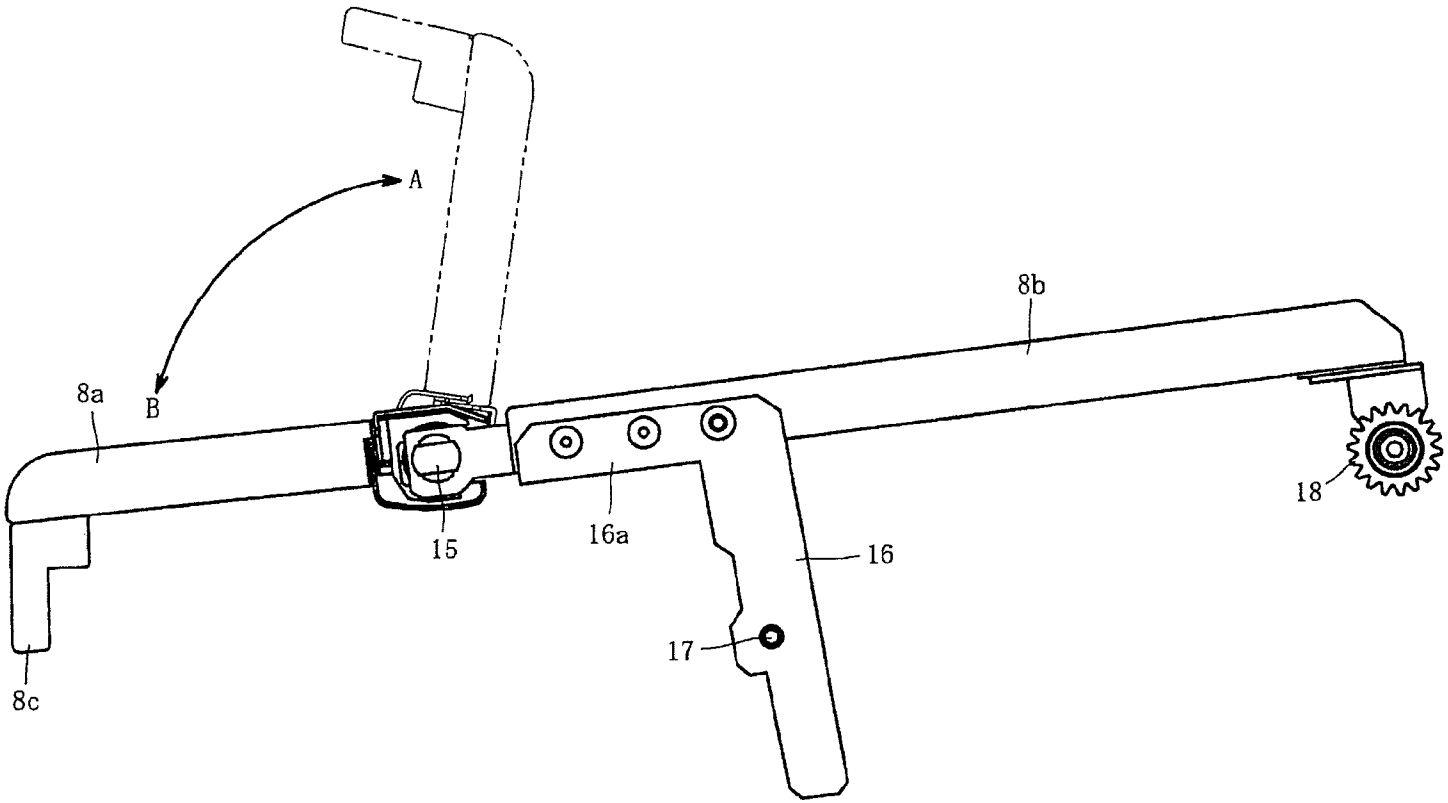
FIG. 2 is a side view of a front lid and a back lid.

The front lid 8*a* and the back lid 8*b* (the keyboard lid 8) are described below with reference to FIG. 2. FIG. 2 is a side view of the front lid 8*a* and the back lid 8*b*. The front lid 8*a* has a sag portion 8*c* protruding downwards from a front portion of the front lid 8*a*, and in the close state, the sag portion 8*c* leans against a top surface of a gate stick 14 (referring to FIG. 1(*a*)), and covers a front surface of the wooden clapper 11 and the keyboard 12 (referring to FIG. 1(*b*)). A rotation shaft 15 is disposed at the back of the front lid 8*a*. The back lid 8*b* is a plate-like member, and is longer than the front lid 8*a* in length along the back and forth direction. The rotation shaft 15 is disposed at the front of the back lid 8*b*, and the back lid 8*b* is connected to the front lid 8*a*.

The rotation shaft 15 is a member rotatably supporting the front lid 8*a* relative to the back lid 8*b*, and is inbuilt with a torque shaft unit of a one-way torque type. The torque shaft unit does not produce a torque when the front lid 8*a* is rotated relative to the back lid 8*b* along an open direction (a direction shown by an arrow A in FIG. 2), and produces a specified torque when the front lid 8*a* is rotated relative to the back lid 8*b* along a close direction (a direction shown by an arrow B in FIG. 2). Therefore, in an open operation, the front lid 8*a* can be opened with a slight force, and can be slowly closed in a close operation.

Moreover, by configuring the torque shaft unit inside the rotation shaft 15, compared to a situation that the torque shaft unit is configured to a member different to the rotation shaft 15, it is unnecessary to additionally set a space of the torque shaft unit around the rotation shaft 15, so that a space around the rotation shaft 15 is effectively used. And, when the torque shaft unit is configured to a member different from the rotation shaft 15, an appearance of the front lid 8*a* and the back lid 8*b* (the keyboard lid 8) around the rotation shaft 15 is spoiled due to the torque shaft unit. In the present embodiment, since the torque shaft unit is built in the rotation shaft 15, the keyboard lid 8 appears elegant.

Moreover, a stopper (not shown) is configured in the rotation shaft 15, and when the rotation shaft 15 rotates along the open direction (the direction shown by the arrow A of FIG. 2) or the close direction (the direction shown by the arrow B of FIG. 2), the stopper limits the rotation to be no more than a predetermined angle. Therefore, the rotation of the front lid 8*a* can be stopped at a predetermined rotation stop position. More specifically, a rotation stop position (as shown by the solid line in FIG. 2) under a close state is at where the front lid 8*a* and the back lid 8*b* are approximately coplanar. And, the rotation stop position (shown by a two-dot chain line in FIG. 2) under the open state is at where the front lid 8*a* rotates along the open direction (the direction shown by the arrow A of FIG. 2) relative to the rotation shaft 15 by about 110° and is slightly oblique to a side of the back lid 8*b*. When the front lid 8*a* reaches the rotation stop position of the open state, the front lid 8*a* requires the specific torque in order to rotate along the close direction (the direction shown by the arrow B of FIG. 2), so that the open state of the front lid 8*a* is stably maintained.

The back lid 8*b* is configured with arms 16 extending downwards from left and right sides of the back lid 8*b*. The arm 16 includes an L-shape member, and a base portion 16*a* of the arm 16 is fixed to a side surface of the front portion of the back lid 8*b*. The arm 16 can be close to the back portion of the back lid 8*b* only though a length part of the base portion 16*a*, and the arm 16 is perpendicular to the back lid 8*b*. As a result, a length between the arm 16 and a front end (the sag portion 8*c*) of the front lid 8*a* is approximately equal to a length between the arm 16 and a back end (a pinion 18) of the back lid 8*b*, so that a centre of gravity of the front lid 8*a* and the back lid 8*b* (the keyboard lid 8) is located around the arm 16.

An engagement pin 17 is engaged to a front guide slot 19 (described later), and back and forth movements of the engagement pin 17 are guided by the front guide slot 19. The engagement pin 17 is configured approximately orthogonal to the arm 16 and the engagement pin 17 protrudes toward an outside of a width direction of the back lid 8*b* (a direction vertical to a page surface of FIG. 2) from the arm 16. Moreover, at two sides of the back portion of the back lid 8*b* along the width direction (the direction vertical to the page surface of FIG. 2), the pinions 18 serving as back guide portions are rotatably configured toward a lower side from the lower surface of the back lid 8*b*. The pinion 18 is engaged to a rack 20 (described later), and the back and forth movements of the pinion 18 are guided by the rack 20.

Figure 3:
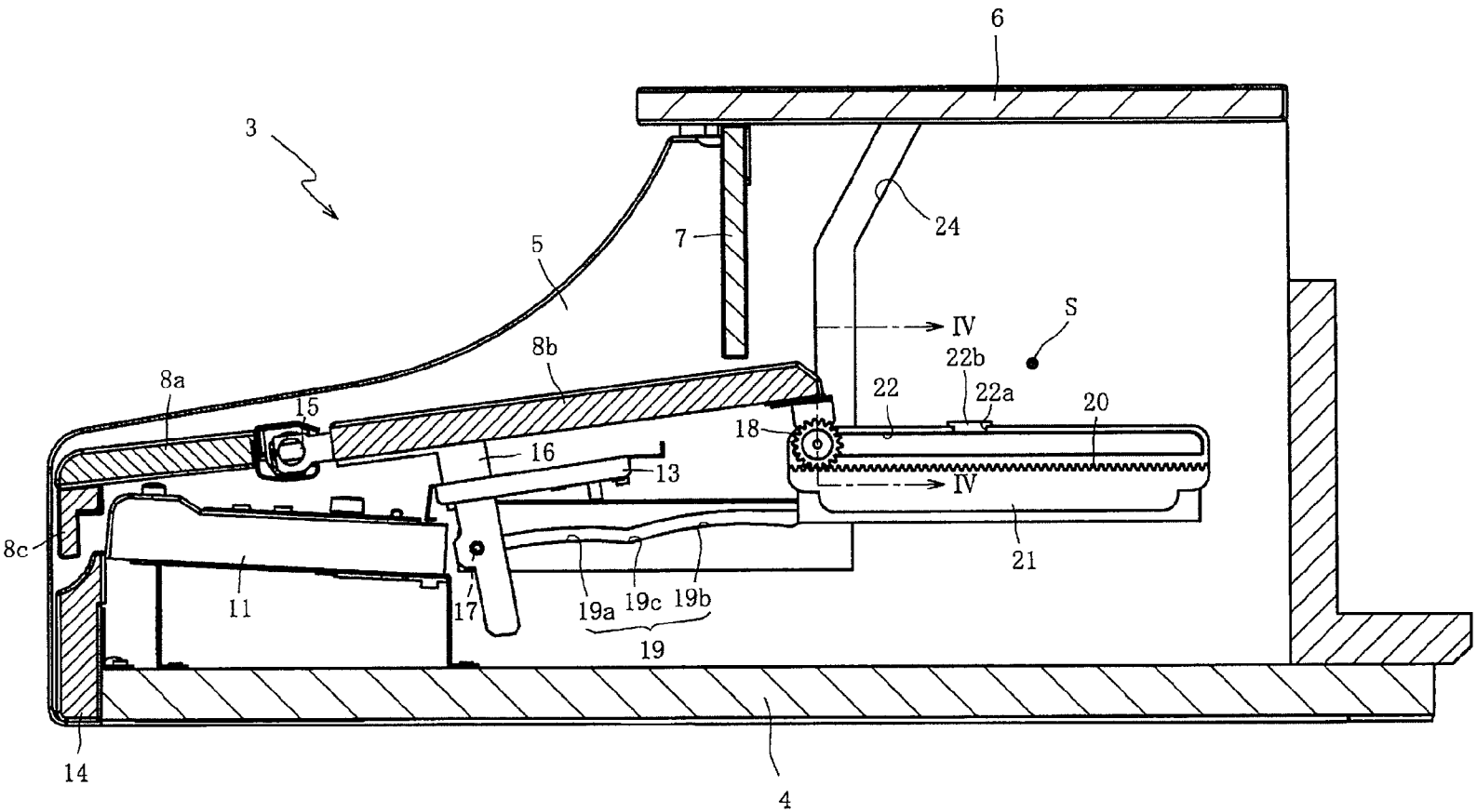
FIG. 3 is a cross-sectional view of an instrument body of FIG. 1(*b*) along a section line with covered keyboard and operation panel.

The lid structure of the keyboard instrument 1 is described below with reference to FIG. 3. FIG. 3 is a cross-sectional view of the instrument body 3 of FIG. 1(*b*) along a section line with the covered keyboard 12 and the operation panel 13. In FIG. 3, the large top lid 10 is omitted.

As shown in FIG. 3, the instrument body 3 has the front guide slots 19 serving as the front guide portions and the racks 20 serving as the back guide portions inside the side plates 5. The front guide slots 19 and the racks 20 are respectively disposed at the left and the right sides of the instrument body 3. Moreover, the operation panel 13 is located behind and above the keyboard 12 (the wooden clapper 11), and is slightly oblique to a player side (a left side of FIG. 3) to facilitate the player operating the operation panel 13.

The front guide slot 19 is engaged to the engagement pin 17 and guides the back and forth movements of the back lid 8*b*, which is formed along a back and forth direction of the instrument body 3 (a left-right direction of FIG. 3). In the present embodiment, the front guide slot 19 has an arc-shaped first slot portion 19*a* and an arc-shaped second slot portion 19*b* protruding upwards. The first slot portion 19*a* has a front end around a back end surface of the wooden clapper 11, and is located under the operation panel 13. The second slot portion 19*b* is connected to the back end of the first slot portion 19*a* and extends to the back of the front plate 7 to reach the front end of the rack 20. A stop portion 19*c* is formed at the back end of the first slot portion 19*a*, i.e. the front end of the second slot portion 19*b*, and the stop portion 19*c* relatively presents a concave shape due to the continuous art-shapes of the first slot portion 19*a* and the second slot portion 19*b*.

The rack 20 is engaged to the pinion 18 and guides the back and forth movements of the back lid 8*b*, which is formed along the back and forth direction of the instrument body 3 (the left-right direction of FIG. 3). Moreover, the rack 20 is located behind the instrument body 3 from the front guide slot 19, and in the present embodiment, the rack 20 is approximately parallel to the shelf 4. An accommodating space S is formed above the rack 20 for accommodating the back lid 8*b* during the open state.

Figure 4:
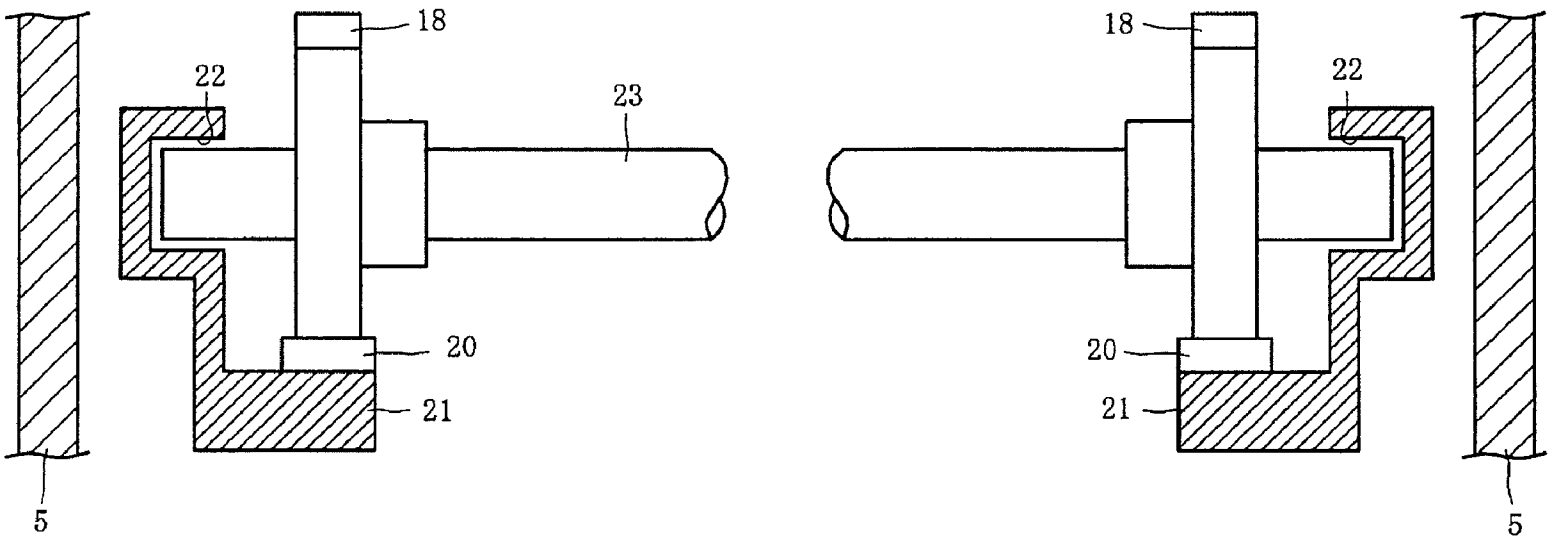
FIG. 4 is a cross-sectional view of the instrument body of FIG. 3 along a section line IV-IV.

The rack 20 and the pinion 18 are described with reference to FIG. 4. FIG. 4 is a cross-sectional view of the instrument body 3 of FIG. 3 along a section line IV-IV. The racks 20 are disposed on top surfaces of assembling members 21 fixed to the side plates 5. Moreover, each back guide slot 22 is formed above and at an outer side of the rack 20, and is parallel to the rack 20. A shaft portion 23 has a length crossing a space between the assembling members 21 respectively fixed to the left and the right side plates 5, and the shaft portion 23 penetrates through the left and right pinions 18, where each shaft end is slidably inserted in the back guide slot 22 respectively.

Referring to FIG. 3, an upper part of the back guide slot 22 is cut at an approximately central portion along the length direction to from a cut portion 22*a*. A width of the cut portion 22*a* is wider than an outer diameter of the shaft portion 23 (referring to FIG. 4), and when the instrument body 3 is assembled, the shaft end of the shaft portion 23 is guided into the back guide slot 22 through the cut portion 22*a*. A blocking member 22*b* is assembled to the upper part of the back guide slot 22 to block the cut portion 22*a* after the shaft end of the shaft portion 23 is guided into the back guide slot 22 through the cut portion 22*a*.

The length of the front guide slot 19, the rack 20 and the back guide slot 22 are set to be long enough to cover the opening-and-closing range of the back lid 8*b*. A sum of a length of a part of the back lid 8*b* between the arm 16 and the rotation shaft 15 and a length of the front lid 8*a* is set to be slightly greater than the length of the keyboard 12 (the wooden clapper 11). In this way, as shown in FIG. 3, when the front lid 8*a* is closed as the engagement pin 17 leans against the front end of the front guide slot 19, the keyboard 12 (the wooden clapper 11) is covered.

Moreover, the rack 20 and the back guide slot 22 are disposed on a height level approximately the same to that of the back of the operation panel 13, and the front guide slot 19 is formed on a height level lower than that of the rack 20 and the back guide slot 22. In this way, as that shown in FIG. 3, the front lid 8*a* and the back lid 8*b* are oblique to the player side (the left side of FIG. 3), and a state (the close state) that the engagement pin 17 leans against the front end of the front guide slot 19 due to a deadweight of the front lid 8*a* and the back lid 8*b* is maintained.

The front guide slot 19 slowly rises in a manner that the back portion thereof is located higher (the upper direction of FIG. 3) than the front portion thereof in the instrument body 3. In detail, the stop portion 19*c* is located higher than the front end of the first slot portion 19*a* in the instrument body 3, and the back end of the second slot portion 19*b* is located higher than the stop portion 19*c* in the instrument body 3. In this way, when the back lid 8*b* is moved to the back of the instrument body 3 (the right side of FIG. 3), the engagement pin 17 configured on and protruded from the arm 16 is engaged to the front guide slot 19 and moves along the front guide slot 19. As the front guide slot 19 slowly rises, the front portion of the back lid 8*b* is raised. Moreover, as the stop portion 19*c* is changed to a rising ramp when the engagement pin 17 is moved from the first slot portion 19*a* to the second slot portion 19*b*, the engagement pin 17, smoothly moving to the back, is prevented.

The back end of the second slot portion 19*b* is connected to a lower end of a longitudinal slot 24. The longitudinal slot 24 is formed on an inner side surface of the side plate 5 and extends from a top end of the side plate 5 towards the shelf 4. Therefore, when the keyboard lid 8 is assembled to the instrument body 3, in the case that the top plate 6, the front plate 7 and the blocking member 22*b* are disassembled, the engagement pin 17 is first inserted to the top end of the longitudinal slot 24 and descends along the longitudinal slot 24. Then, the engagement pin 17 is guided to the front guide slot 19 from the back end of the second slot portion 19*b*. Thereafter, as the engagement pin 17 slides towards the first slot portion 19*a*, the shaft end of the shaft portion 23 (shown in FIG. 4) is inserted to the back guide slot 22 through the cut portion 22*a*. The blocking member 22*b* is then assembled to the cut portion 22*a* to facilitate the assembly of the keyboard lid 8 to the instrument body 3.

Figure 5:
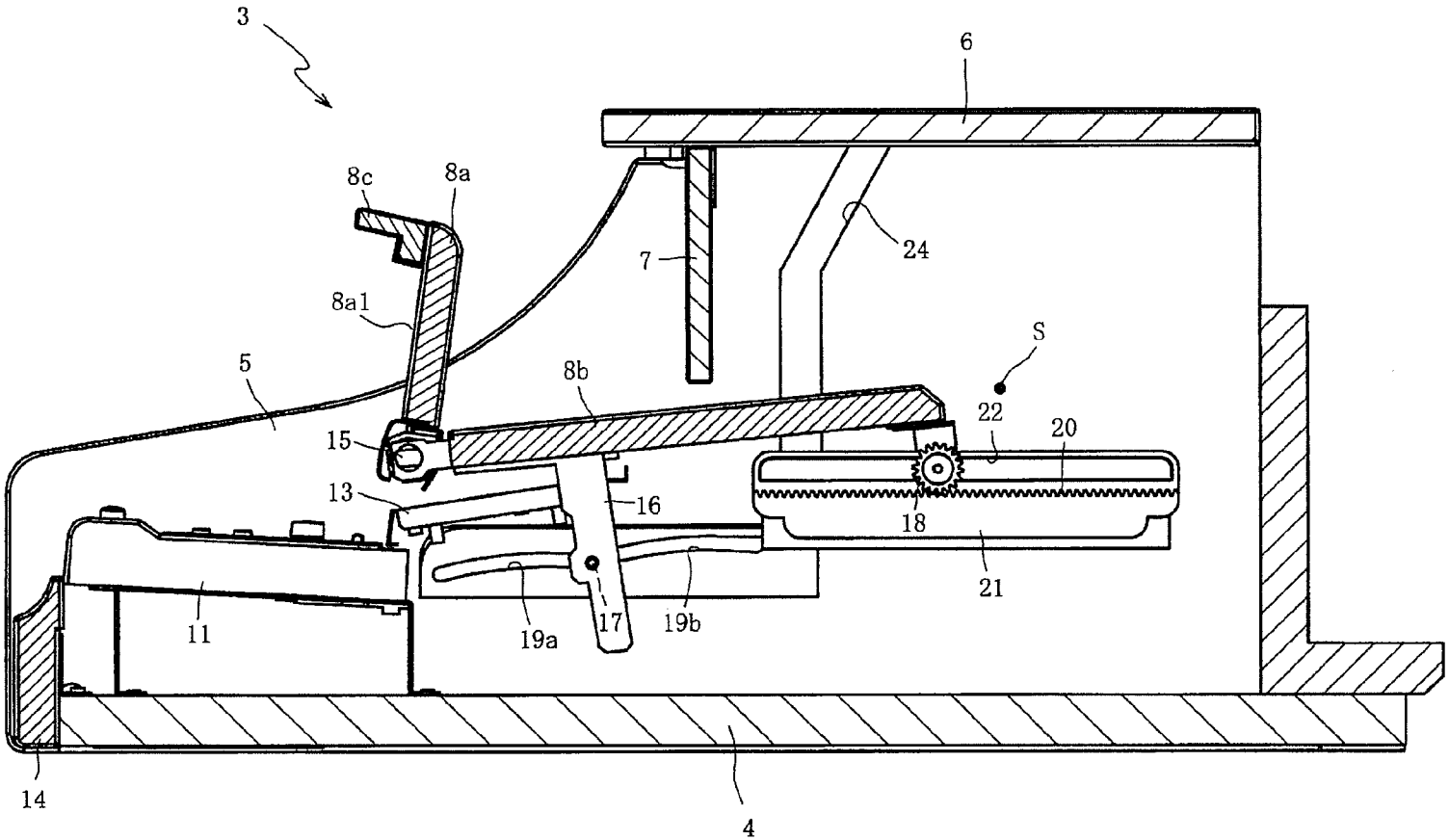
FIG. 5 is a cross-sectional view of an instrument body with an opened keyboard and a covered operation panel.

A method of using the keyboard instrument 1 when the keyboard 12 is opened to the player side is described below with reference to FIG. 5. FIG. 5 is a cross-sectional view of the instrument body 3 with an opened keyboard 12 and a covered operation panel 13. When the keyboard 12 is to be opened to the player side, under the close state of the keyboard lid 8 shown in FIG. 3, the sag portion 8*c* is held to lift the front lid 8*a*. Now, because no torque is applied to the torque shaft unit (not shown) built in the rotation shaft 15, the front lid 8*a* is opened by only applying a slight force. When the front lid 8*a* rotates along the rotation shaft 15, the front lid 8*a* stops at the rotation stop position (shown by the two-dot chain line of FIG. 2), and at the rotation stop position, a centre of gravity of the front lid 8*c* and the sag portion 8*c* is located posterior to a shaft centre of the rotation shaft 15. In this way, the front lid 8*a* is stably maintained to the open state.

Moreover, the front lid 8*a* is shorter than of the keyboard 12 in length, so that when the front lid 8*a* is rotated, only a part (a front side) of the keyboard 12 is opened. When the front lid 8*a* is further pushed backwards (the right side of FIG. 3), the shaft portion 23 (referring to FIG. 4) moves along the back guide slot 22, and the pinion 18 is engaged to the rack 20 for movement. In this way, the back lid 8*b* smoothly moves in the instrument body 3 without swaying. Moreover, since the left and right pinions 18 are penetrated by the shaft portion 23 (referring to FIG. 4), the extent of movement of the left and right pinions 18 is simultaneous, and no matter what portion of the keyboard lid 8 is operated on, the open and close operation is smoothly performed.

Moreover, the engagement pin 17 smoothly moves along the first slot portion 19*a*. When the engagement pin 17 reaches the stop portion 19*c*, the smooth movement of the back lid 8*b* is stopped, and the engagement pin 17 is stopped. In addition, as shown in FIG. 5, since the back lid 8*b* is oblique to the player side (the left side of FIG. 5), the load of the back lid 8*b* functions on the stop portion 19*c* through the engagement pin 17, and a friction between the stop portion 19*c* and the engagement pin 17 is increased, so that a stop state of the engagement pin 17 in the stop portion 19*c* is maintained.

Here, the length of the first slot portion 19*a* is set to be approximately the same to a length of a part of the back lid 8*b* between the arm 16 and the rotation shaft 15. Moreover, since the operation panel 13 is disposed above the first slot portion 19*a*, when the engagement pin 17 is stopped by the stop portion 19*c* (referring to FIG. 4), the rotation shaft 15 is located above a boarder of the keyboard 12 (the wooden clapper 11) and the operation panel 13. Therefore, the keyboard 12 is opened corresponding to the position where the engagement pin 17 is stopped by the stop portion 19*c*. On the other hand, the operation panel 13 is covered by the back lid 8*b*. In this way, observing from the player side, the instrument body 3 closely appears to an acoustic piano.

Moreover, a back surface 8*a*1 of the front lid 8*a* now faces the player side (the left side of FIG. 5). The back surface 8*a*1 may be coated to form a glossy surface, and the fingers of the player in performance are mapped on the back surface 8*a*1 of the front lid 8*a*, which may enhance the satisfaction of the player in the performance.

Figure 6:
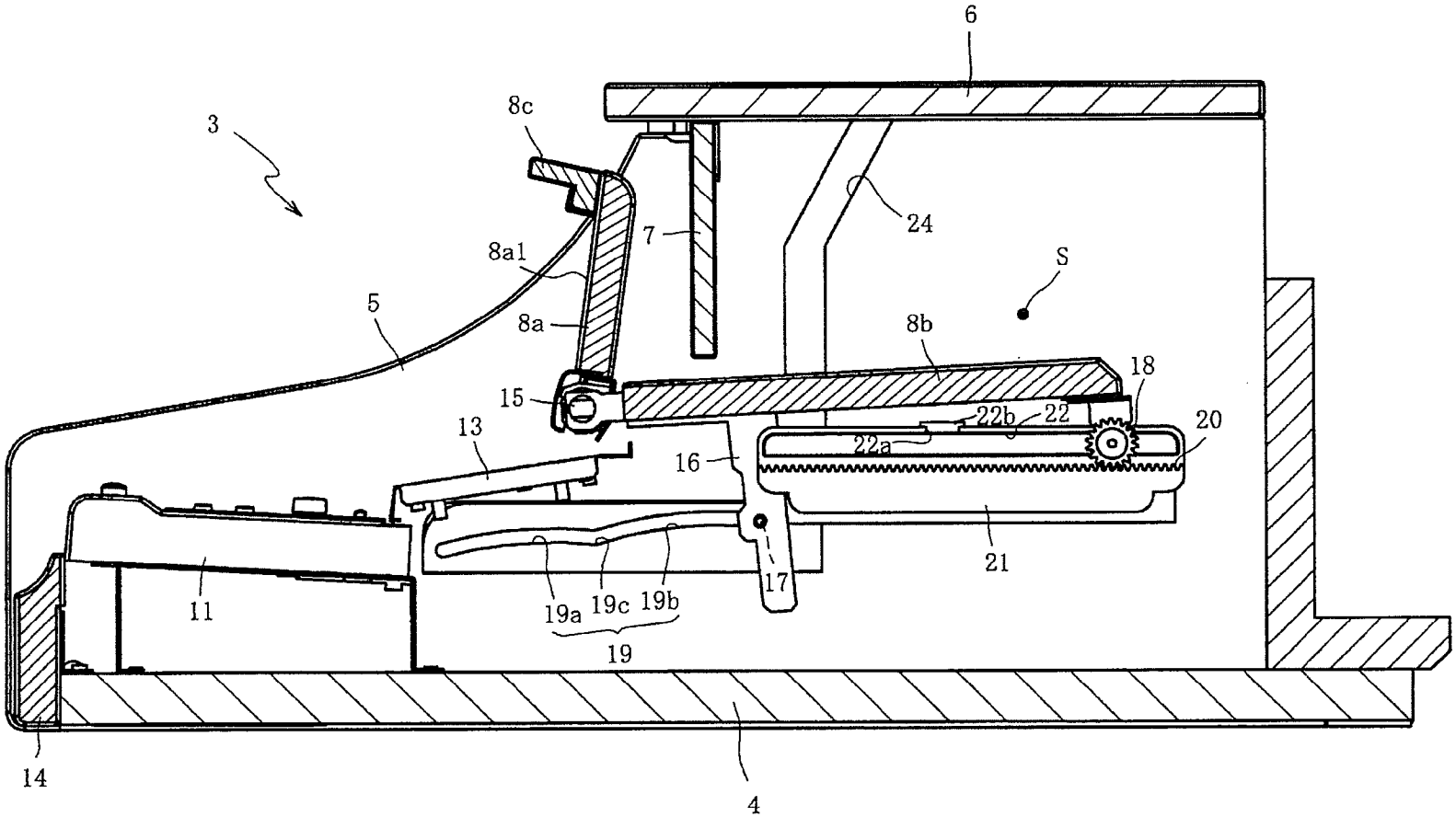
FIG. 6 is a cross-sectional view of an instrument body with an opened keyboard and an operation panel.

A method of using the keyboard instrument 1 when the keyboard 12 and the operation panel 13 are opened to the player side is described below with reference to FIG. 6. FIG. 6 is a cross-sectional view of the instrument body 3 with an opened keyboard 12 (the wooden clapper 11) and an operation panel 13. When the keyboard 12 and the operation panel 13 are opened to the player side, if the front lid 8*a* is further pushed backwards (the right side of FIG. 5) from a state as shown in FIG. 5, the engagement pin 17 is moved from the stop portion 19*c* to the second slot portion 19*b*. When the engagement pin 17 leans against the back end of the second slot portion 19*b*, a further backward movement thereof is stopped.

Herein, the length of the second slot portion 19*b* is set to be approximately the same to a length of the operation panel 13 along the back and forth direction (the left-right direction of FIG. 6), so that when the engagement pin 17 leans against the back end of the second slot portion 19*b*, the rotation shaft 15 is located above the back of the operation panel 13. As a result, when the engagement pin 17 leans against the back end of the second slot portion 19*b*, the keyboard 12 and the operation panel 13 may be opened. In this way, the player may operate both the operations devices of the operation panel 13 and the keyboard 12. The back surface 8*a*1 of the front lid 8*a* now faces the player side (the left side of FIG. 5), so that the fingers of the player in performance are mapped to the back surface 8*a*1 (the glossy surface) of the front lid 8*a*, which may enhance the satisfaction of the player in the performance.

Moreover, the front guide slot 19 rises in a manner that the back portion of the front guide slot 19 is located higher than the front portion thereof in the instrument body 3, so that as the engagement pin 17 moves backwards, the front portion of the back lid 8*b* is raised. Therefore, even if the operation panel 13 is disposed at a position higher than that of the keyboard 12 or is oblique to the player side, a situation that the front portion of the back lid 8*b* interferes with the operation panel 13 when the back lid 8*b* is moved back and forth can be avoided. In this way, allocation or design degree of freedom of the operation panel 13 can be enhanced.

As described above, as the rack 20 is located posterior to the front guide slot 19, and the front guide slot 19 and the rack 20 are respectively engaged to the engagement pin 17 and the pinion 18, the back lid 8*b* is supported between the front guide slot 19 and the rack 20, and the back lid 8*b* approximately maintains a pose to pass through the underneath of the front plate 7 and moves backwards. A gap between a lower end of the front plate 7 and the rack 20 and the accommodating space S are required to only have at least the thickness of the back lid

8*b*, so that an overall height of the instrument body 3 can be suppressed to a low level. Therefore, a design degree of freedom of the instrument body 3 can be enhanced.

Moreover, since the front lid 8*a* has the length shorter than that of the keyboard 12, even if the height of the instrument body 3 (a height of the front plate 7 along a vertical direction) is not further increased, a situation that the front end (the sag portion 8*c*) of the front lid 8*a* in the open state protrudes out from the top of the instrument body 3 (the upper side of FIG. 6) is avoided. In this way, regarding a relationship with the length of the front lid 8*a*, the overall height of the instrument body 3 can be suppressed to a low level, so that the design degree of freedom of the instrument body 3 can be enhanced. Moreover, since the keyboard instrument 1 has the music score board 9 disposed on the top plate 6 (referring to FIG. 1(*a*)), as long as the overall height of the instrument body 3 is suppressed to the low level in order to suppress the height of the top plate 6, a relationship between a height of a sight line of the player and the height of the music score can be sufficiently considered to design the instrument body 3.

Moreover, since the engagement pin 17 is disposed on and protruded from the arm 16 extending downwards from the back lid 8*b*, and the front guide slot 19 is located under the operation panel 13, the front guide slot 19 is disposed inconspicuously in the instrument body 3. In this way, the front guide slot 19 is obviated from becoming an obstruction for the player, and the keyboard instrument 1 with a good appearance is provided.

In a conventional keyboard instrument, a keyboard lid is formed by dividing a plate into a louver-shape, and the plates are pliably connected and are slidable along the back and forth direction. Since the keyboard lid covers the keyboard 12 and the operation panel 13, in the conventional keyboard instrument, guide slots used for guiding the keyboard lid to move back and forth are formed all over the front place and back place within the side plates 5. In this situation, the guide slots formed in front of the side plates 5 may become an obstruction for the player.

Comparatively, in the keyboard instrument 1 of the present embodiment, the engagement pin 17 is disposed on and protruded from the arm 16 extending downwards from the back lid 8*b*, and the engagement pin 17 is engaged to the front guide slot 19 formed under the operation panel 13, so that the front guide slot 19 is covered by the operation panel 13. Moreover, the rack 20 is covered by the front plat 7. In this way, the front guide slot 19 or the rack 20 is avoided to become an obstruction for the player, so as to prevent degrading the appearance when the lid is opened.

Moreover, when the lid is opened, a length of the back lid 8*b* protruding backwards from the front plate 7 (a movable range of the back lid 8*b*) is shortened due to the front lid 8*a* erected relative to the back lid 8*b*. In this way, when the lid is opened, a depth of the instrument body 3 (a depth of the accommodating space S) required for accommodating the back lid 8*b* may be shortened, by which the design degree of freedom of the instrument body 3 is enhanced. As a result, the keyboard instrument 1 with a reduced front-back size and an elegant design is implemented.

Moreover, in order to avoid interference, no component is disposed in the movable range of the back lid 8*b*. However, the movable range of the back lid 8*b* may be reduced in the keyboard instrument 1, so that the space at the back of the instrument body 3 is effectively used, and configuration degree of freedom of the components is enhanced.

In addition, in the present embodiment, the engagement pin 17 is equivalent to the front engagement portion, and the front guide slot 19 is equivalent to the front guide portion. The pinion 18 is equivalent to the back engagement portion, and the rack 20 is equivalent to the back guide portion. Moreover, the shaft portion 23 is equivalent to the back engagement portion, and the back guide slot 22 is equivalent to the back guide portion.

The invention is described with reference to the aforementioned embodiments, though the invention is not limited thereto, and it can be deduced that various modifications and variations can be made without departing from the scope or spirit of the invention. For example, the values mentioned in the aforementioned embodiments are only used as an example, and other values can also be adopted.

In the aforementioned embodiments, the keyboard instrument 1 of a grand piano type is used as an example for descriptions, though the invention is not limited thereto, and other keyboard instruments such as an upright piano or an organ, etc. are also applicable.

In the aforementioned embodiments, a situation that the engagement pin 17 serving as the front engagement portion is engaged to the front guide slot 19 serving as the front guide portion is described, though the invention is not limited thereto, and a concave and convex relationship of these members can be reversed. For example, the front guide slot 19 is replaced by a protruding strip (the front guide portion), and the engagement pin 17 is replaced by a U-shape member (the front engagement portion) having a recess engaged to the protruding strip. Similarly, by configuring U-shape members having recesses at two ends of the shaft portion 23 in a free rotation manner and replacing the protruding strips engaged to the U-shape members by the back guide slots 22, the pinion 18 is also prevented from falling off from the rack 20.

In the aforementioned embodiments, a situation of disposing the engagement pin 17 (the front engagement portion) on the arm 16 in protrusion and disposing the front guide slot 19 (the front guide portion) in the instrument body 3 is described. However, a relationship of theses members can also be reversed. For example, the arm 16 may have a relatively long length along the back and forth direction, and a guide slot (the front engagement portion) is formed on the arm 16 to replace the engagement pin 17, and on the other hand, a protruding engagement pin (the front guide portion) engaged to the guide slot (the front engagement portion) is configured on the instrument body 3 to replace the front guide slot 19. Moreover, the guide slot (the front engagement portion) formed on the arm 16 can also be replaced by a protruding strip, and the engagement pin (the front guide portion) is replaced by a U-shape member having a recess engaged to the protruding strip.

In the aforementioned embodiments, a situation of disposing the pinion 18 (the back engagement portion) on the back lid 8*b* and disposing the rack 20 (the back guide portion) in the instrument body 3 (the side plate 5) is described, though the invention is not limited thereto, and a relationship of theses members can also be reversed. For example, the rack (the back engagement portion) is fixed on the back lid 8*b* along the back and forth direction, and on the other hand, the pinion (the back guide portion) engaged to the rack (the back engagement portion) is fixed on the instrument body 3 (the side plate 5).

In the aforementioned embodiments, the engagement pin 17 (the front engagement portion), the pinion 18 (the back engagement portion), the front guide slot 19 (the front guide portion) and the rack 20 (the back guide portion) are described as an example. As long as one of the front engagement portion and the front guide portion contains a slot, a rack or a protruding strip, etc. extending along the back and forth direction, and another one of the front engagement portion and the front guide portion contains a pin, a pinion, a roller or a concave member, etc. capable of engaging to the slot, the rack and the protruding strip, the back lid 8*b* can be guided along the back and forth direction.

Similarly, as long as one of the back engagement portion and the back guide portion contains a slot, a rack or a protruding strip, etc. extending along the back and forth direction, another one of the back engagement portion and the back guide portion contains a pin, a pinion, a roller or a concave member, etc. capable of engaging to the slot, the rack and the protruding strip.

Moreover, in the aforementioned embodiments, the front engagement portion and the back engagement portion are respectively described, though a part of the front engagement portion and the back engagement portion can be connected in structure. For example, in case that the front engagement portion and the back engagement portion contain a slot-shape guide portion, the front engagement portion and the back engagement portion can also be slot-shape guide portions connected to each other. Similarly, a part of the front guide portion and the back guide portion can be connected in structure, and in case that the front guide portion and the back guide portion contain a slot-shape guide portion, the front guide portion and the back guide portion can also be slot-shape guide portions connected to each other.

In the aforementioned embodiments, a situation that the rack 20 and the pinion 18 are used to slide the back lid 8*b* smoothly is described, though the invention is not limited thereto, and other members engaged to each other can also be used. For example, a guide rail and a roller (for example, a rubber roller) maintained thereon by friction on one hand and capable of rolling thereon on the other hand can be used to serve as the engaged members. Moreover, a slot-shape guide portion and a pin engaged to the slot-shape guide portion that are respectively the same to the front guide slot 19 and the engagement pin 17 can also be used. Now, synchronization achieved by using the left and right racks 20 and pinions 18 cannot be implemented, though guiding accuracy of the back and forth movement can be improved, so as to prevent swaying of the back lid 8*b* when the keyboard lid 8 is opened and closed.

Moreover, the back engagement portion and the back guide portion can be simple members other than the engagement pin and the guide slot or the pinion and the rack. For example, a part (a back portion) of the back lid 8*b* can be set as the back engagement portion, and the protruding strip guide portion is formed on the instrument body 3 (the side plate, etc.), and the protruding strip guide portion is set as the back guide portion. Now, the back lid 8*b* is guided by the back guide portion along the back and forth direction. By using such simple members to construct the back engagement portion and the back guide portion, the fabrication cost of the keyboard instrument 1 is reduced.

In the aforementioned embodiments, a situation that the stop portion 19*c* is formed in the front guide slot 19 is described, though the invention is not limited thereto. Instead of setting the stop portion 19*c* in the front guide slot 19, a stop portion used to stop rolling of the pinion 18 can be set at a specific position on the rack 20 or the back guide slot 22. Now, similar as above, the back and forth movement of the back lid 8*b* can be stopped at a specific position.

In the aforementioned embodiments, when the back lid 8*b* is fully opened (referring to FIG. 6), the engagement pin 17 leans against the back end of the front guide slot 19 to stop the movement of the back lid 8*b*. Though the invention is not limited thereto. A stopper can be configured on the rack 20, and when the pinion 18 leans against or stopped by the stopper, the movement of the back lid 8*b* is stopped. Moreover, the stopper leaning against or stopping any part of the keyboard lid 8 can be configured on the instrument body 3.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A lid structure of a keyboard instrument, covering a keyboard and an operation panel disposed posterior to the keyboard in a free open-and-close manner, the lid structure of the keyboard instrument comprising:

a front lid, disposed aside a player in a close state;

a back lid, connected to a back of the front lid;

a rotation shaft, disposed at a front portion of the back lid and a back portion of the front lid, and rotatably supporting the front lid relative to the back lid;

a front engagement portion, connected to each of two sides of the front portion of the back lid;

a back engagement portion, connected to each of two sides of a back portion of the back lid;

a front guide portion, disposed in an instrument body, and engaged to the front engagement portion to guide a movement of the back lid along a back and forth direction; and a back guide portion, disposed posterior to the front guide portion, built in the instrument body, and engaged to the back engagement portion to guide the movement of the back lid along the back and forth direction.

2. The lid structure of the keyboard instrument as claimed in claim 1, wherein, the front lid has a length shorter than a length of the keyboard along the back and forth direction, and at a rotation stop position of an open state, a back surface of the front lid faces a player side, at least one of the front engagement portion, the front guide portion, the back engagement portion and the back guide portion has a stop portion used for stopping the movement of the back lid along the back and forth direction, the stop portion is formed at a place where the keyboard is opened relative to the player and the operation panel is covered relative to the player.

3. The lid structure of the keyboard instrument as claimed in claim 1, wherein, the front engagement portion is formed on an arm extending downwards from the back lid, and the front engagement portion and the front guide portion are located under the operation panel.

4. The lid structure of the keyboard instrument as claimed in claim 1, wherein, the front engagement portion or the front guide portion extends along the back and forth direction of the instrument body, and a back portion of the front engagement portion or the front guide portion is located higher than a front portion of the front engagement portion or the front guide portion in the instrument body.

5. The lid structure of the keyboard instrument as claimed in claim 1, wherein, a torque shaft unit is built in the rotation shaft, and the torque shaft unit produces a specified torque when the front lid is rotated relative to the back lid along a close direction.

* * * * *